US009796493B2

(12) United States Patent
Casadei

(10) Patent No.: US 9,796,493 B2
(45) Date of Patent: Oct. 24, 2017

(54) THIN PALLET WRAPPING PLATFORM

(71) Applicant: C&C GROUP S.r.l., Cesena (FC) (IT)

(72) Inventor: Claudio Casadei, Cesena (IT)

(73) Assignee: C&C GROUP S.R.L., Vialla Calabra di Cesena (IT)

( * ) Notice: Subject to any disclaimer, the term of this patent is extended or adjusted under 35 U.S.C. 154(b) by 53 days.

(21) Appl. No.: 14/288,478

(22) Filed: May 28, 2014

(65) Prior Publication Data

US 2014/0353896 A1 Dec. 4, 2014

(30) Foreign Application Priority Data

May 31, 2013 (IT) ..... RN2013A0020

(51) Int. Cl.
*B65B 11/04* (2006.01)
*B65B 65/02* (2006.01)

(52) U.S. Cl.
CPC ..... *B65B 11/045* (2013.01); *B65B 65/02* (2013.01)

(58) Field of Classification Search
CPC ..... B65B 11/045; B65B 65/02; B65B 59/04
USPC ..... 269/61, 58; 53/211, 587
See application file for complete search history.

(56) References Cited

U.S. PATENT DOCUMENTS 3,626,654 A * 12/1971 Hoffler et al. ..... B65B 53/066 206/386
3,724,022 A 4/1973 Alberti et al.
4,050,221 A * 9/1977 Lancaster, III ..... B65B 11/045 53/211
4,568,070 A * 2/1986 Severt ..... B23K 37/04 269/60
4,662,151 A * 5/1987 Mathes ..... A01F 15/071 53/118
4,926,617 A * 5/1990 Van Mill ..... A01F 15/071 53/211
5,168,691 A * 12/1992 Errani ..... B65B 11/045 53/211

(Continued)

FOREIGN PATENT DOCUMENTS

DE 102011004803 A1 8/2012
EP 0205909 A1 12/1986

(Continued)

OTHER PUBLICATIONS

Italian Search Report dated Feb. 19, 2014 from counterpart app No. IT RN20130020.

(Continued)

*Primary Examiner* — Joseph J Hail
*Assistant Examiner* — Arman Milanian
(74) *Attorney, Agent, or Firm* — Shuttleworth & Ingersoll, PLC; Timothy J. Klima

(57) ABSTRACT

A pallet wrapping platform comprises a lower frame, a pallet supporting table, constraining means interposed between the frame and the table, being designed to allow the frame and table to move by rotating relative to one another, a driving unit and transmission means for transmitting the motion from the driving unit to the table. The table comprises an upper flat disk and at least one lower ring gear, fixed to the disk and designed to interact with the motion transmission means, in such a way that the total thickness of the platform is less than at least 24 millimeters.

6 Claims, 4 Drawing Sheets

(56) References Cited

U.S. PATENT DOCUMENTS

| | | | | |
|---|---|---|---|---|
| 5,212,933 | A * | 5/1993 | Cere' | B65B 11/025 53/556 |
| 5,365,723 | A * | 11/1994 | Ramos | B65B 11/045 53/211 |
| 5,606,849 | A * | 3/1997 | Bettenhausen | B65B 11/045 53/210 |
| 5,794,418 | A * | 8/1998 | Lai | B65B 11/045 53/389.4 |
| 7,178,317 | B1 * | 2/2007 | Koskela | B65B 41/12 242/597.8 |
| 9,284,079 | B2 * | 3/2016 | Hendren | B65B 11/045 |
| 2003/0126833 | A1 * | 7/2003 | Marchetti | B65B 11/045 53/211 |
| 2004/0031238 | A1 * | 2/2004 | Cox | B65B 11/045 53/399 |
| 2008/0078588 | A1 * | 4/2008 | Draper | G01G 21/22 177/145 |
| 2012/0175170 | A1 * | 7/2012 | Martin | B65B 11/045 177/201 |

FOREIGN PATENT DOCUMENTS

| | | | |
|---|---|---|---|
| GB | 902864 | A | 8/1962 |
| WO | 03091102 | | 11/2003 |

OTHER PUBLICATIONS

European Search Reported dated Sep. 26, 2014 from counterpart European App No. 14001851.6.

European Office Action dated Sep. 25, 2015 from counterpart European App No. 14001851.6.

European Office Action dated Feb. 12, 2016 from counterpart European App No. 14001851.6.

Jan. 18, 2016 Response to European Office Action dated Sep. 25, 2015 from counterpart European App No. 14001851.6.

* cited by examiner

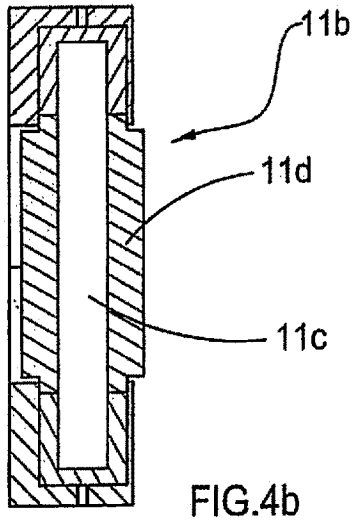
FIG.4b
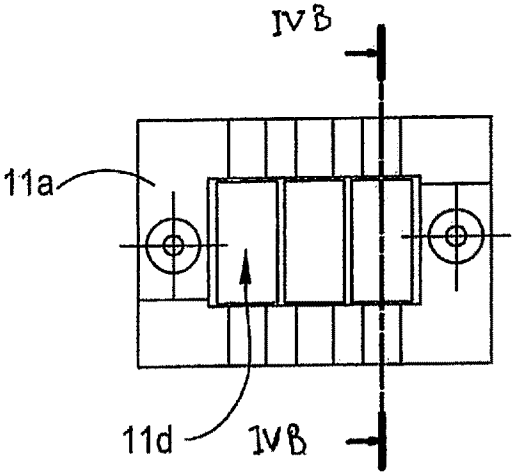
FIG.4a
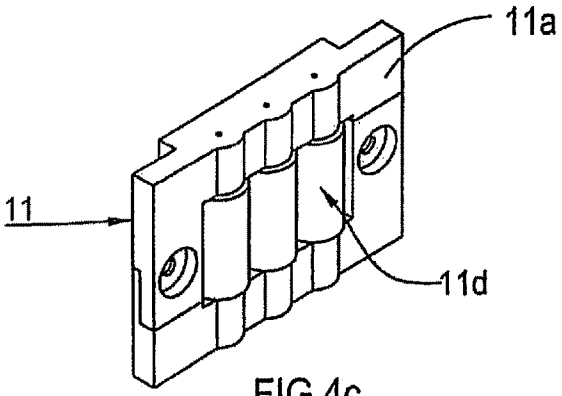
FIG.4c
FIG.4

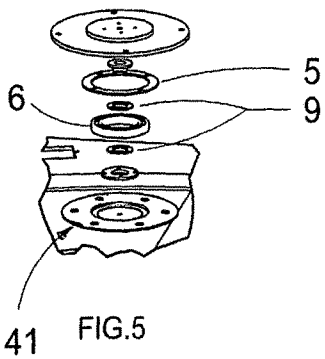
FIG.5
FIG.6b
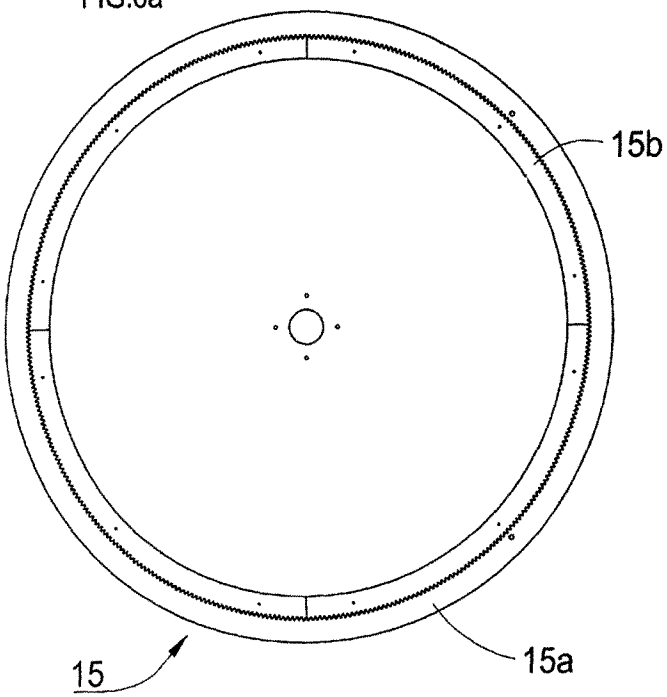
FIG.6
FIG.6a

THIN PALLET WRAPPING PLATFORM

This application claims priority to Italian Patent Application RN2013A000020 filed May 31, 2013, the entirety of which is incorporated by reference herein.

TECHNICAL FIELD

This invention relates to a thin pallet wrapping platform.

BACKGROUND ART

The now global diffusion of large-scale distribution has produced an ancillary industry, linked to packaging techniques, in which even small improvements in the production and operation of the devices used bring significant economic benefits, due to the "big numbers" in this sector.

In particular, in the wrapping of pallets (understood to be a stacked set of packaging units, for example crates) using plastic films, rotary platforms are often used, onto which the pallet must first be lifted, before its movement can be started. The platforms currently used are several centimeters thick (usually between 5 and 10) and therefore have up ramps which, due to the mass of the pallet, make the moment it is loaded on the platform critical.

Document WO 03/091102 discloses a platform, friction moved by a motor driver wheel, wherein the pallet should mount a height of about 25 millimeters.

Other documents, as for example, US 2012/0175170, disclose a platform with a greater thickness, moved by a belt transmission device.

Moreover, the distance between the base of the platform and the base of the pallet may make it difficult to transfer the rotating motion from the driving units to the pallet.

The aim of this invention is, therefore, to eliminate the above-mentioned disadvantages.

The invention, as characterised in the claims, achieves that aim thanks to a platform with reduced thickness, at least less than 24 millimeters and preferably less than 20.

The main advantage of this invention is basically the fact that the dimensions of the pallet up ramp are reduced as far as possible, in terms of both height and length.

Moreover, the transfer of the motion from the driving unit to the platform is simplified and allows a reduction in consumption, the power used being the same.

Finally, structural work is not used to make the platform.

BRIEF DESCRIPTION OF THE DRAWINGS

Further advantages and features of the invention are more apparent in the detailed description which follows, with reference to the accompanying drawings, which illustrate an example embodiment of it without limiting the scope of the invention, in which:

FIG. 4 is a perspective view 4*c*, a plan view 4*a* and a cross-section 4*b* of a detail of the invention;

FIG. 5 is an exploded view of a detail of the invention;

FIG. 6 is a bottom plan view 6*a* and a side view 6*b* of a detail of the invention.

Figure 1:
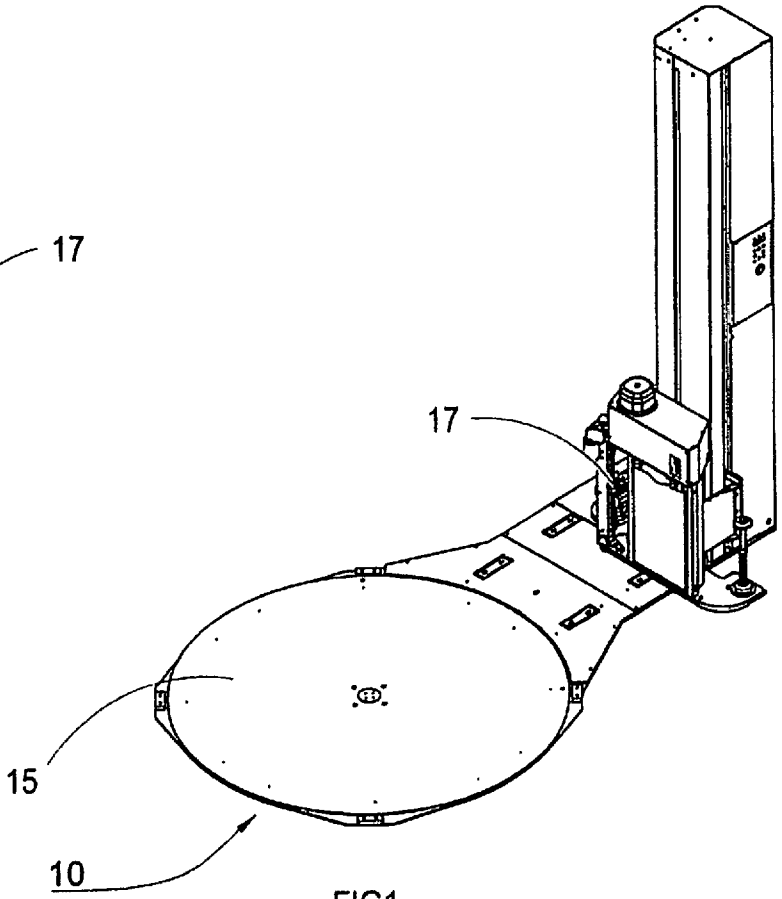
FIG. 1 is a perspective assembly view of the invention.
Figure 2:
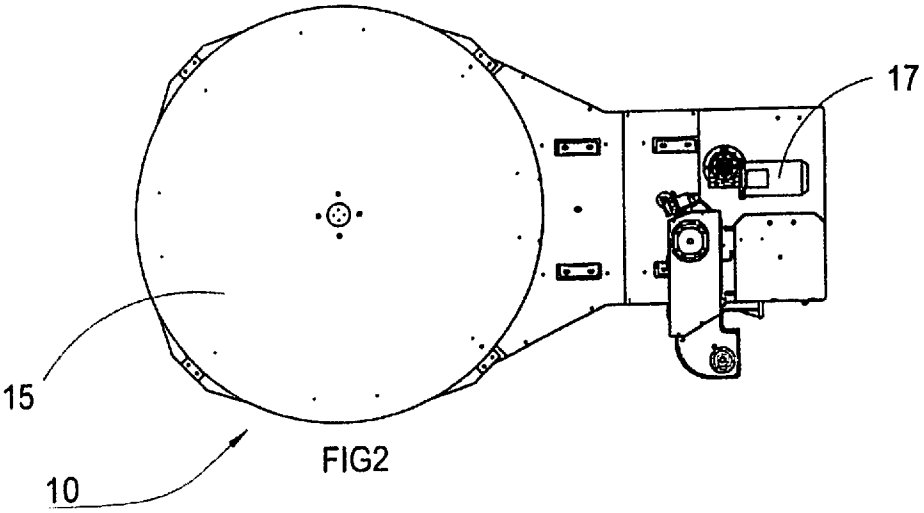
FIG. 2 is a top plan view of the invention.
Figure 3:
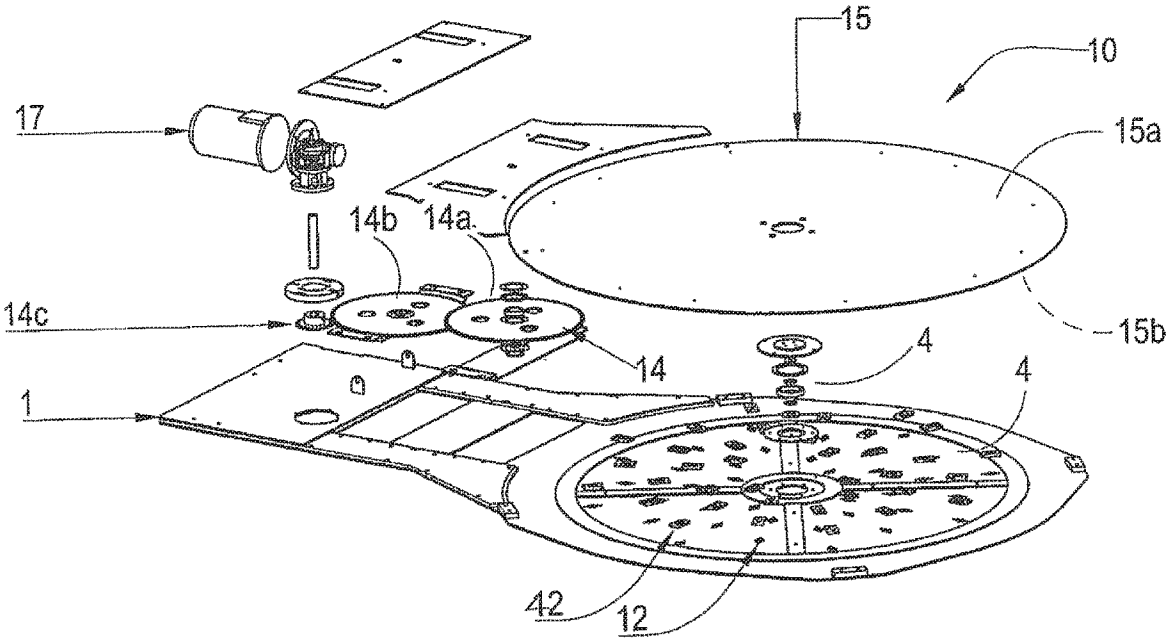
FIG. 3 is an exploded view of the invention.

As shown in the figures, the invention relates to a pallet wrapping platform, comprising a lower frame 1, a pallet supporting table 15, constraining means 4 interposed between the frame 1 and the table 15, being designed to allow the frame and table to move by rotating relative to one another, a driving unit 17 and transmission means 14 for transmitting the motion from the driving unit 17 to the table 15. The table 15 comprises an upper flat disk 15*a* and at least one lower crown wheel 15*b*, fixed to the disk 15*a* and designed to interact with the motion transmission means 14.

The join between the disk 15*a* and the crown wheel 15*b* is preferably made by welding, and in any case without the use of structural work, thereby allowing a total thickness s of the platform 10 which is less than 24 millimeters, and preferably comprised between 18 and 20 millimeters.

In the embodiment illustrated in the figures, the constraining means 4 comprise a central rotation device 41 and a peripheral rotation device 42. The central rotation device 41 comprises a plurality of bearings 5, 6, 9, designed to promote the movement of the table 15 relative to the frame 1. The peripheral rotation device 42 comprises a plurality of supporting units 11, distributed radially in seats 12 of the frame 1, being designed to promote the movement of the table 15 relative to the frame 1 and to give it resistance relative to the weight of the pallet. As shown in FIG. 4, each supporting unit 11 comprises a box-shaped body 11*a*, with dimensions matching those of the seats 12 of the frame 1, and at least one roller 11*b*, free to rotate relative to its own axis, housed in the box-shaped body 11*a* and slightly protruding from it. Each roller 11*b* comprises a core 11*c* made of highly rigid material, for example steel, in such a way as to provide suitable support for the table 15 above, and a cover 11*d*, preferably made of a plastic material commercially known as DERLIN®, suitable for limiting friction and noise.

In that embodiment, the motion transmission means 14 comprise a plurality of gear wheels 14*a*, 14*b*, 14*c*, which allow the motion to be transferred from the driving unit 17 to the table 15 supporting the pallet, interacting with the edge of the lower crown wheel 15*b*.

The invention described above may be modified and adapted in several ways without thereby departing from the scope of the inventive concept. Moreover, all details of the invention may be substituted by technically equivalent elements.

Obviously, in practice modifications and/or improvements are possible, all covered by the claims herein.

The invention claimed is:

1. A pallet wrapping platform, comprising:

a lower frame, a pallet supporting table, including:

an upper flat disk with an exposed upward facing surface for supporting the pallet and a downward facing surface facing the lower frame;

an annular crown wheel having an upper surface in direct contact with the downward facing surface at an outer peripheral area of the upper flat disk, the crown wheel having a geared surface on a circumference thereof, the crown wheel and upper flat disk together forming an upwardly recessed area in the table directly radially inwardly of the crown wheel;

a rotational mounting system rotatably mounting the table to the lower frame, the rotational mounting system including;

a central rotation device having a central axis about which the table rotates, the central rotation device directly mounting the table to the lower frame and including a bearing for reducing rotational friction;

a peripheral rotation device including a plurality of rollers attached to the lower frame and distributed around a circumference of the lower frame radially inwardly of the crown wheel to be positioned beneath the table in the upwardly recessed area of the table to engage the downward facing surface of the table to support the table;

a drive motor, and a transmission engaging between the drive motor and the crown wheel for rotationally driving the table, the transmission including at least one gear attached to the motor for operatively engaging the geared surface of the crown wheel;

wherein the platform has a maximum thickness of less than 24 millimeters at the table.

2. The pallet wrapping platform of claim 1, wherein the drive motor is positioned outside a periphery of the pallet supporting table and the geared surface of the crown wheel is positioned on an external circumference of the crown wheel.

3. The pallet wrapping platform of claim 2, wherein the crown wheel has a diameter smaller than a diameter of the upper flat disk such that the geared surface of the crown wheel is positioned radially inwardly of an external circumference of the upper flat disk.

4. The pallet wrapping platform of claim 3, wherein the at least one gear of the transmission includes at least one intermediate gear operatively positioned between the at least one gear attached to the motor and the geared surface of the crown wheel.

5. The pallet wrapping platform of claim 1, wherein the crown wheel has a diameter smaller than a diameter of the upper flat disk such that the geared surface of the crown wheel is positioned radially inwardly of an external circumference of the upper flat disk.

6. The pallet wrapping platform of claim 1, wherein the at least one gear of the transmission includes at least one intermediate gear operatively positioned between the at least one gear attached to the motor and the geared surface of the crown wheel.

* * * * *